US006050062A

United States Patent [19]

Petersson et al.

[11] Patent Number: 6,050,062

[45] Date of Patent: Apr. 18, 2000

[54] MULTIPLE MAGAZINE FOR A PACKAGING MACHINE

[75] Inventors: Göran Petersson, Wheeling; Sven-Arne Andersson, Buffalo Grove, both of Ill.

[73] Assignee: Tetra Laval Holdings & Finance, SA, Pully, Switzerland

[21] Appl. No.: 09/063,908

[22] Filed: Apr. 21, 1998

[51] Int. Cl.[7] ..... B65B 3/02; B65B 43/14; B65B 43/52; B65B 59/00

[52] U.S. Cl. ..... 53/458; 53/168; 53/202; 53/250; 53/468; 53/565

[58] Field of Search ..... 53/458, 456, 468, 53/202, 168, 565, 564, 250, 249, 253; 493/125, 123, 122, 165, 164

[56] References Cited

U.S. PATENT DOCUMENTS

| | | | |
|---|---|---|---|
| 3,137,981 | 6/1964 | Johnson et al. | 53/202 X |
| 3,918,236 | 11/1975 | Allen | 53/202 X |
| 4,448,008 | 5/1984 | Pankratz et al. | 53/202 |
| 4,790,123 | 12/1988 | Ljungström et al. | 53/458 |
| 4,922,687 | 5/1990 | Chow et al. | 53/474 X |
| 5,687,779 | 11/1997 | Andersson et al. | 141/105 |
| 5,706,627 | 1/1998 | Kirka et al. | 53/52 |

*Primary Examiner*—James F. Coan
*Attorney, Agent, or Firm*—Welsh & Ratz, Ltd.

[57] ABSTRACT

A packaging system having a multiple magazine for providing different carton blanks to a single form, fill and seal packaging machine is disclosed in the present invention. The packaging system has the multiple magazine apparatus, the packaging machine, a carton opener and optionally an automatic carton loader. The present invention also discloses the multiple magazine apparatus having a plurality of magazines, and means for retrieving blanks therefrom.

18 Claims, 12 Drawing Sheets

MULTIPLE MAGAZINE FOR A PACKAGING MACHINE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to magazines for form, fill and seal packaging machines. Specifically, the present invention relates to magazines capable of holding and processing a multitude of different carton blanks.

2. Description of the Related Art

Packages formed from a blank are usually processed on a linear form, fill and seal packaging machine. Each blank is delivered to a mandrel of the packaging machine from a carton blank opener. The blank opener is fed with a series of blanks from a magazine. The magazine holds a stack of flat blanks that are erected on the carton blank opener prior to placement on the mandrel.

Once on the mandrel, each carton has its bottom formed prior to placement on a conveyor. On the conveyor, each carton may be fitted with a fitment and sterilized prior to filling and top sealing. Novel filling techniques as disclosed in U.S. Pat. No. 5,687,779 have emerged to fulfill a need in the packaging industry, that need being the ability of a packaging machine to consecutively fill cartons with different products. This breakthrough in the packaging industry has created additional problems that must be met before the full potential of the novel filling systems is realized by dairies and other producers of flowable food products such as milk, juice, yogurt and the like.

The most pressing need is to provide different blanks to the packaging machine for processing into cartons for each of the different products. This need must also take into account the space limitations, and other integral attachments of a packaging machine.

BRIEF SUMMARY OF THE INVENTION

The present invention resolves the newly created problems of the novel filling systems by providing a multiple magazine apparatus. The multiple magazine apparatus is integrated with a carton opener that provides erected cartons to a packaging machine. The packaging machine may be a single processing line or dual processing line machine. A multiple magazine apparatus and carton opener is provided for each line of a dual processing line machine. An automatic carton loader may also be integrated into an overall packaging system.

The present invention allows for a single packaging machine to process different products during a single production cycle. For example, skim milk, whole milk and two percent milk may be produced during a single production cycle without suspending the operation. Also, the same product for different retail distributors may be produced in a single production cycle. Further, it is contemplated that various products ranging from juice, to milk to yogurt may be filled in cartons on a single packaging machine during a single production cycle.

It is a primary object of the present invention to provide a packaging system for filling various products consecutively on a packaging machine, each of the different products having its own distinguishing carton.

It is an additional object of the present invention to provide a multiple magazine for a packaging machine.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a packaging system of the present invention;

Figure 2:
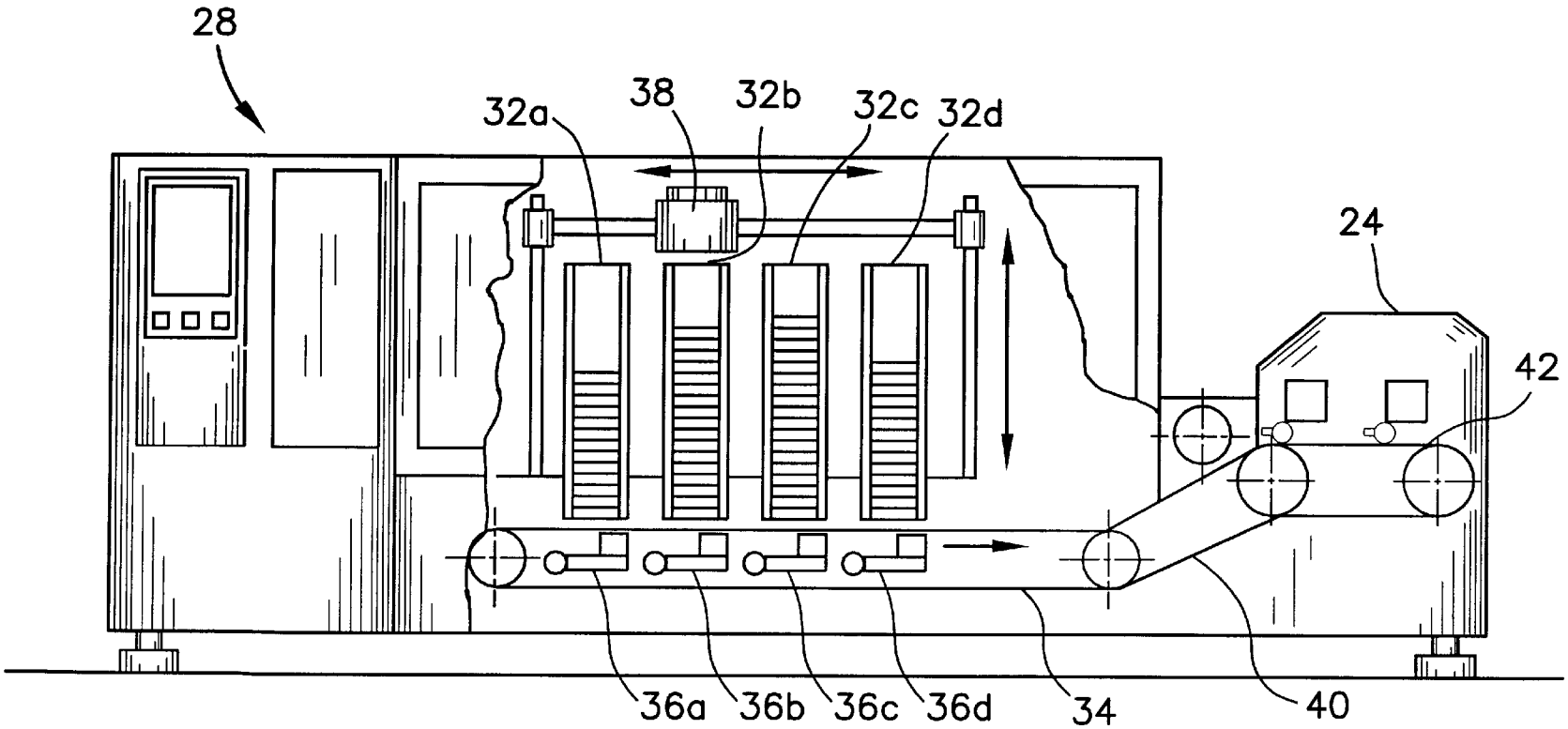
Figure 3:
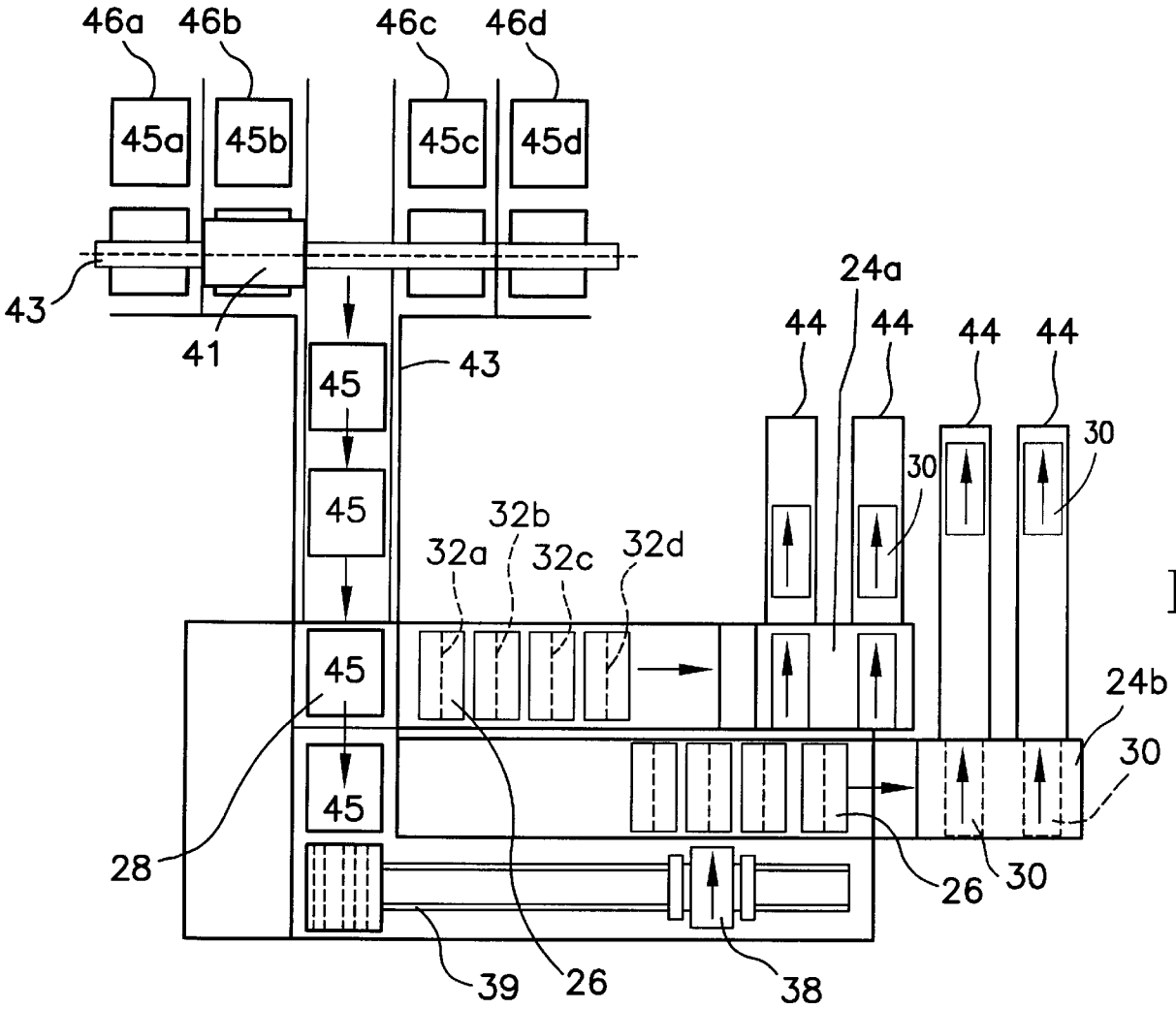
Figure 4:
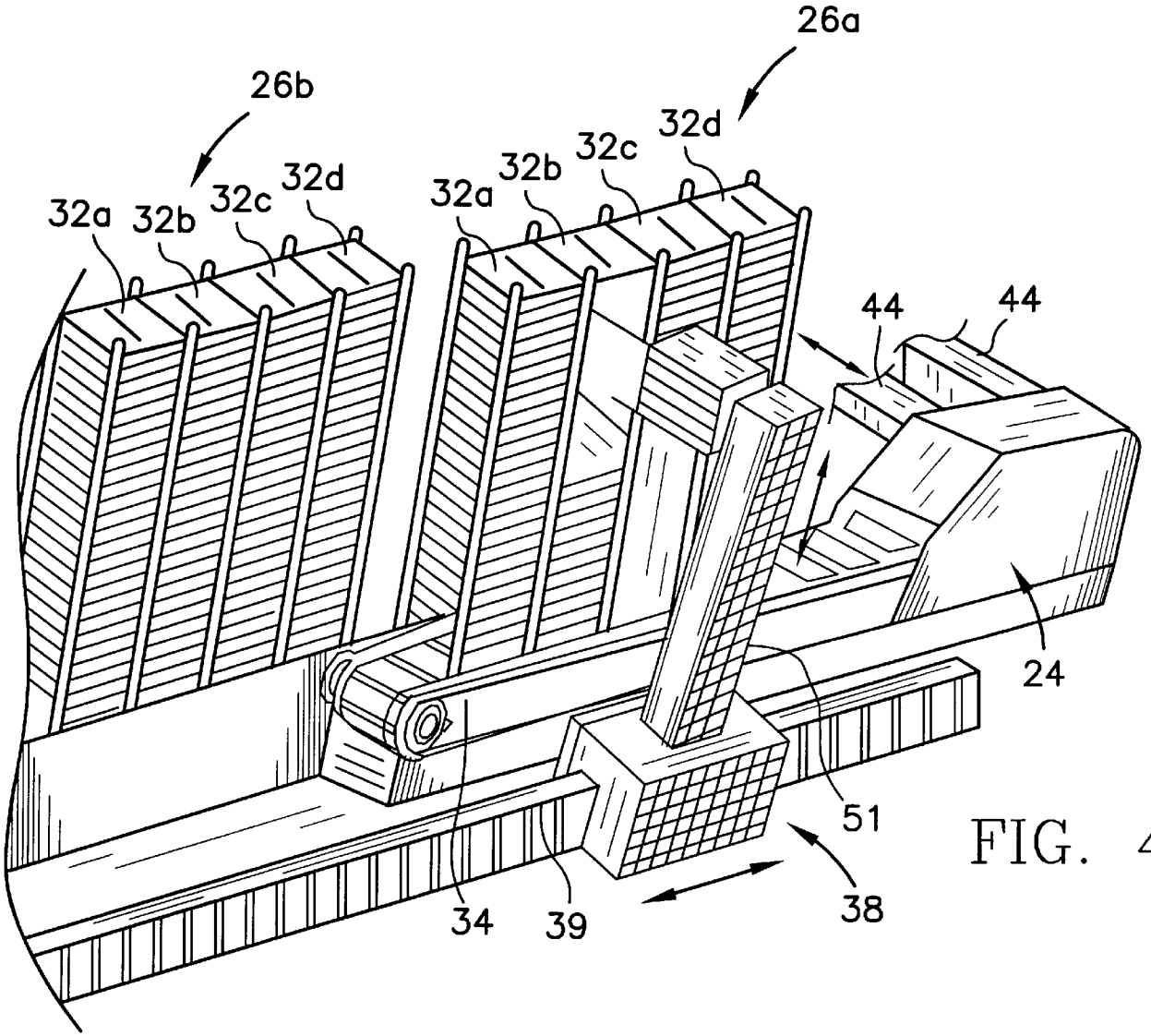
Figure 5:
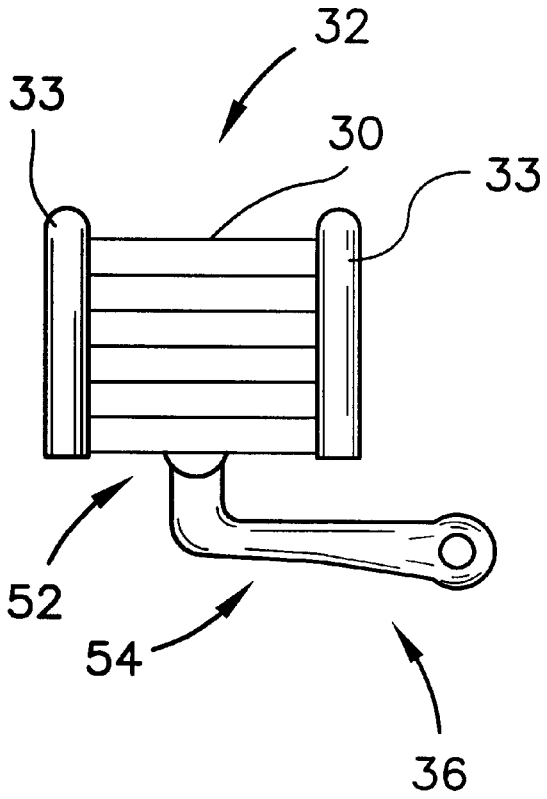
Figure 5A:
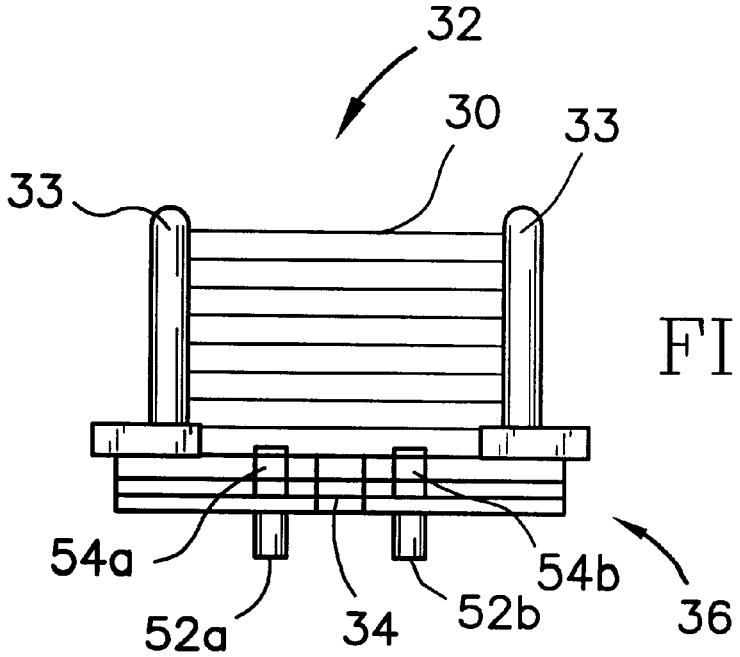
Figure 6:
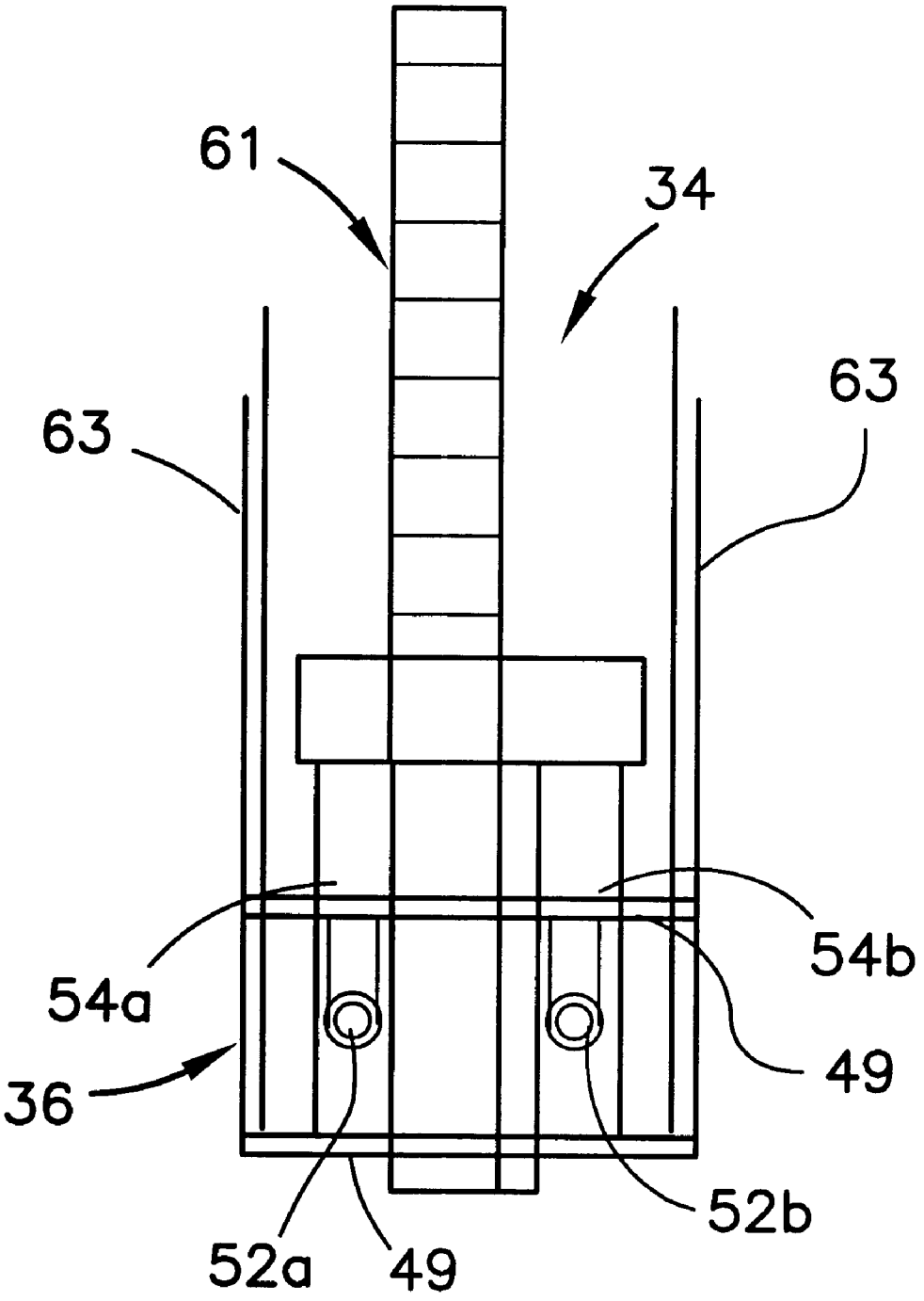
Figure 7:
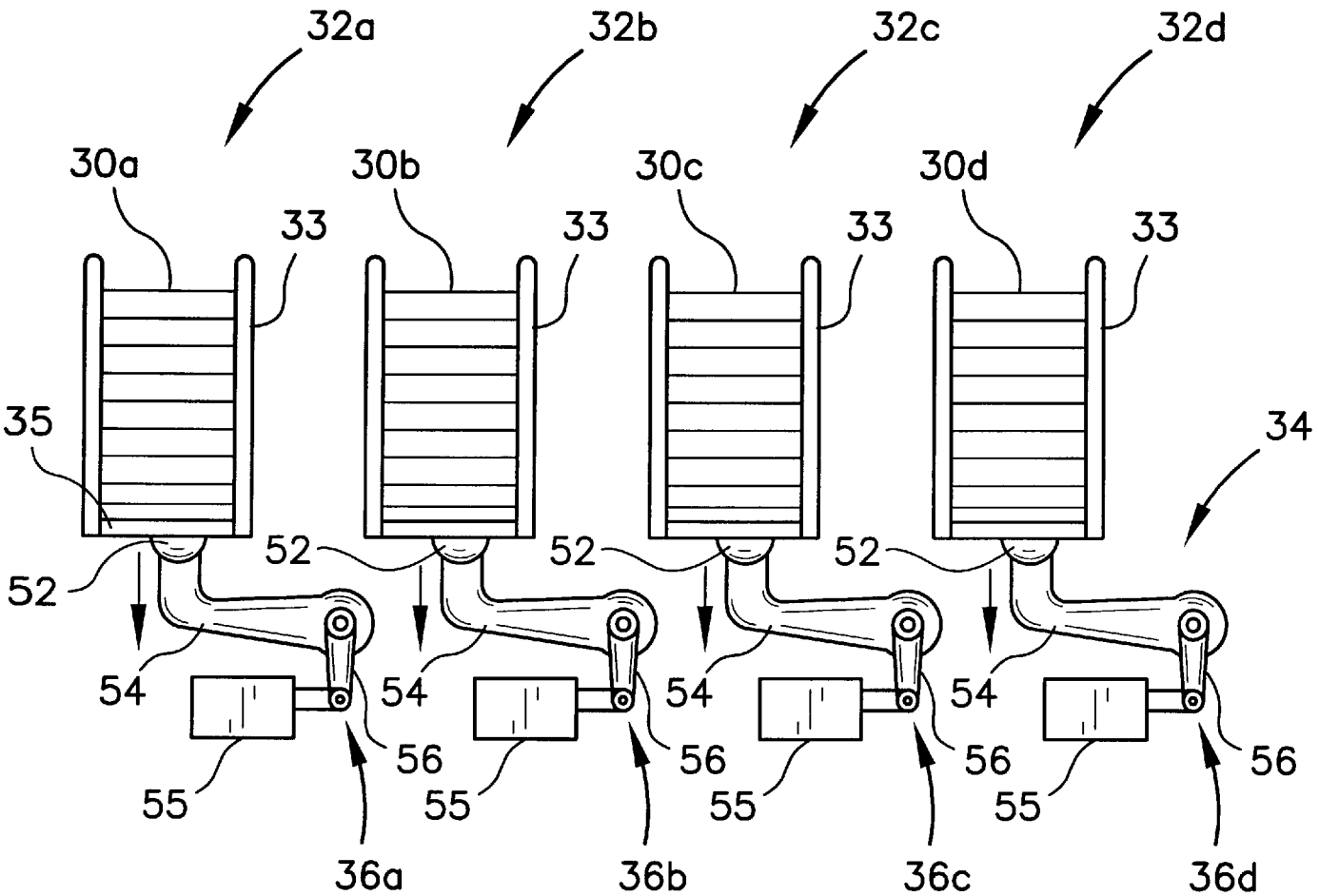
Figure 8:
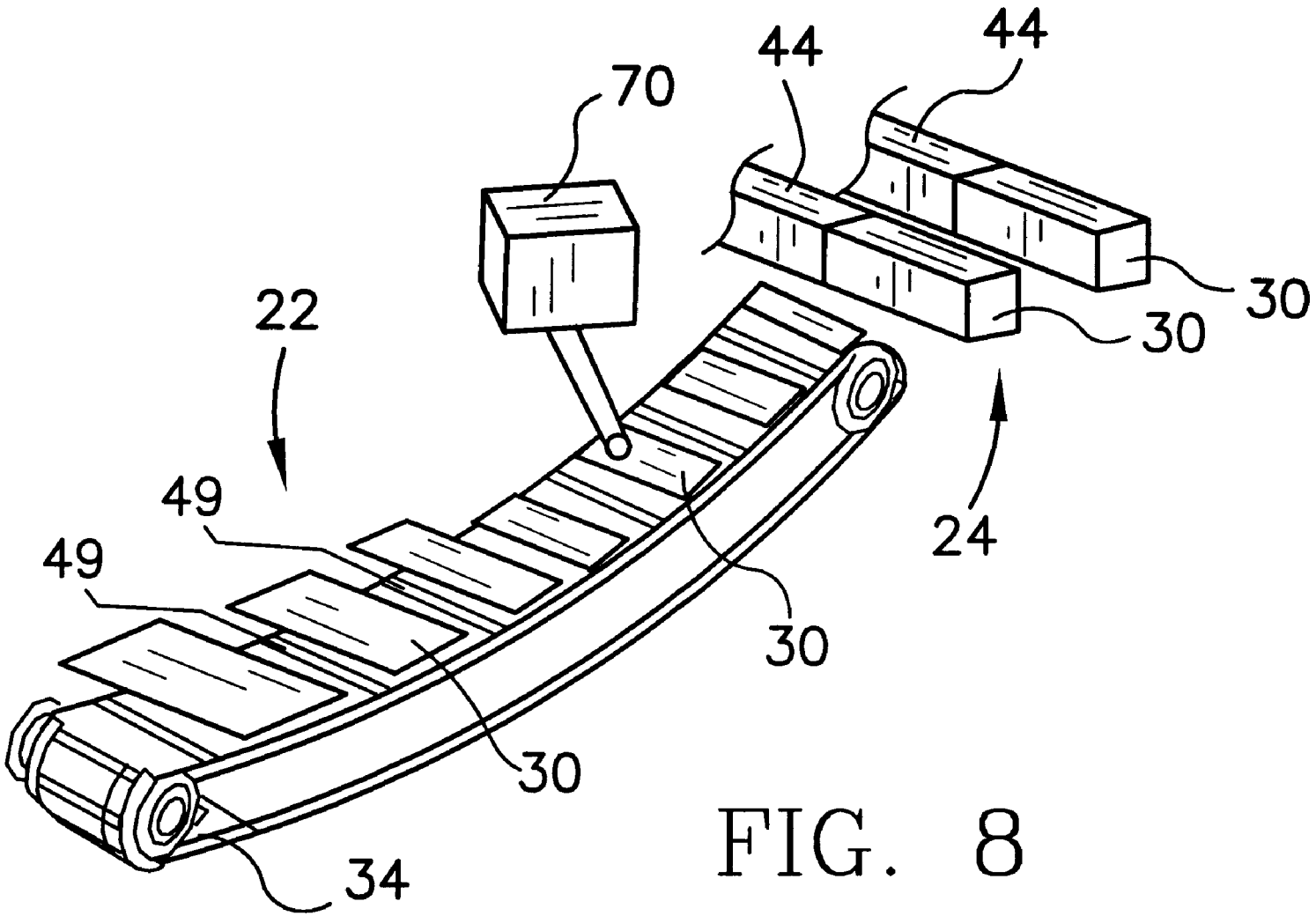
Figure 8A:
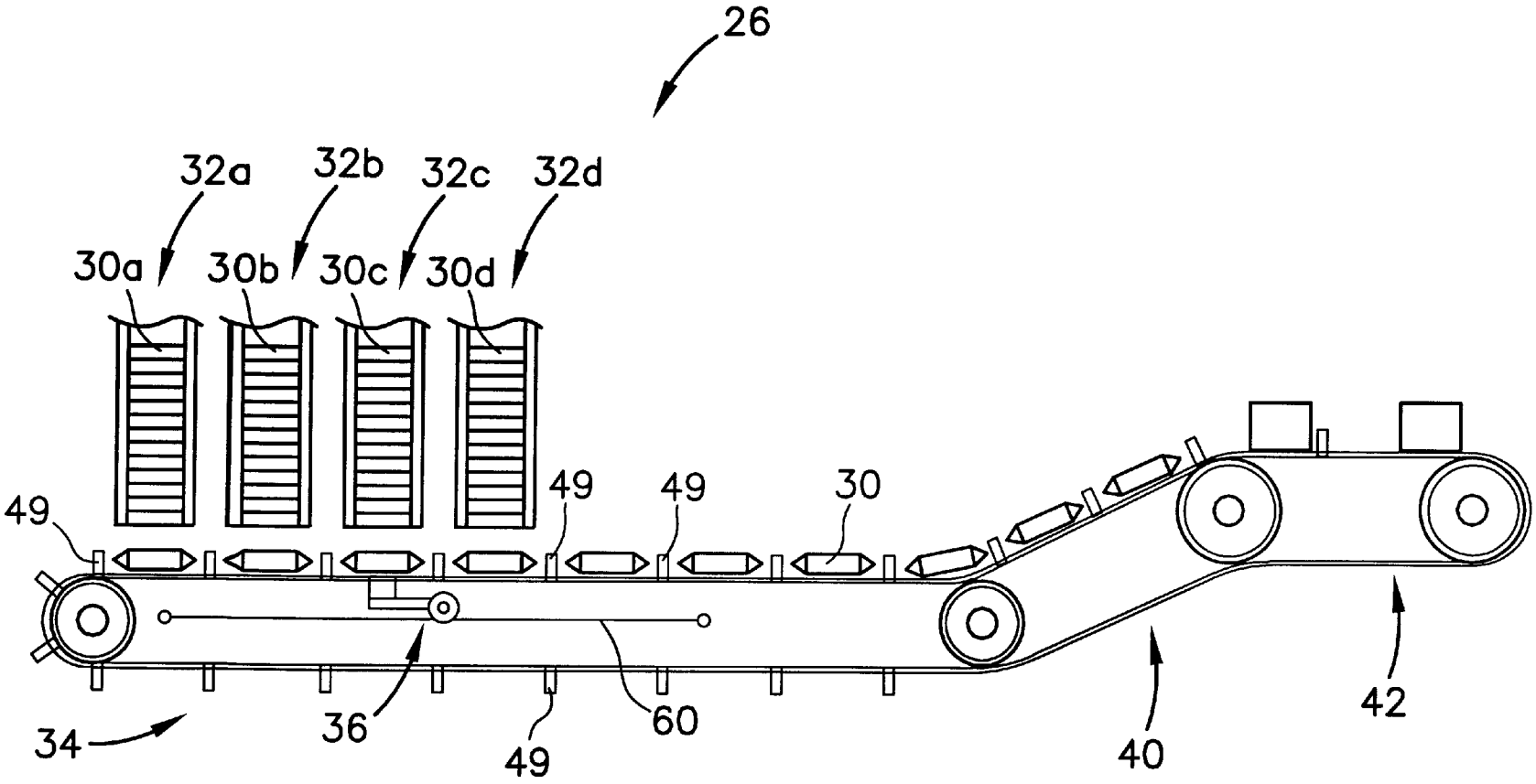
Figure 9:
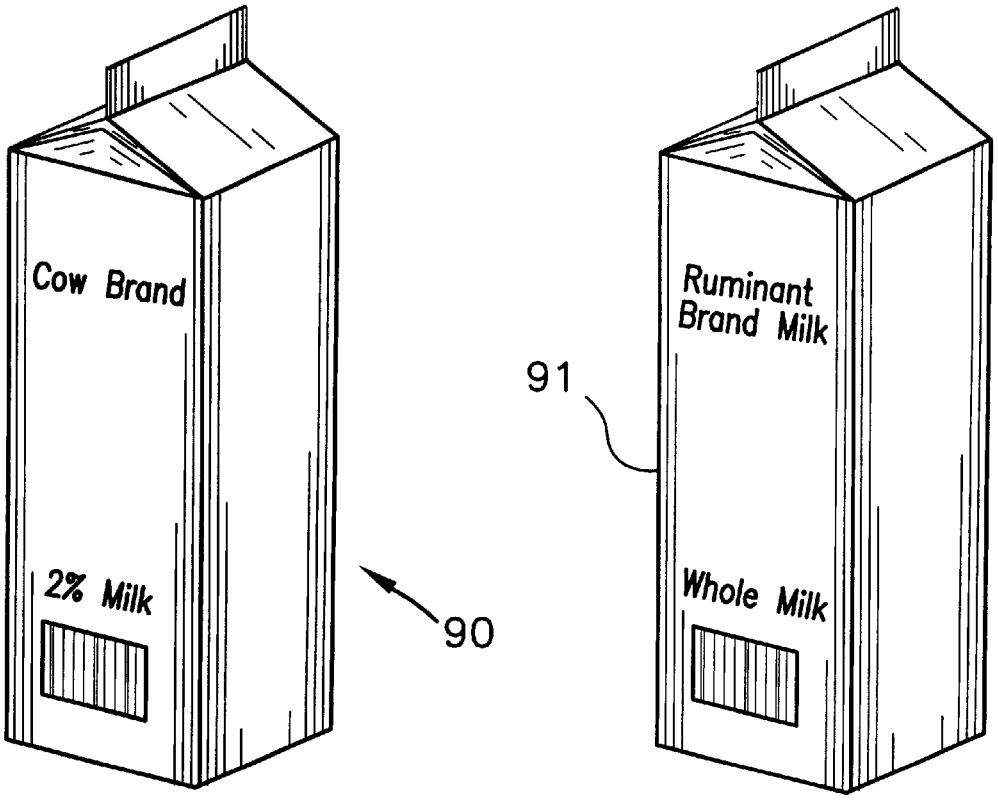
Figure 9A:
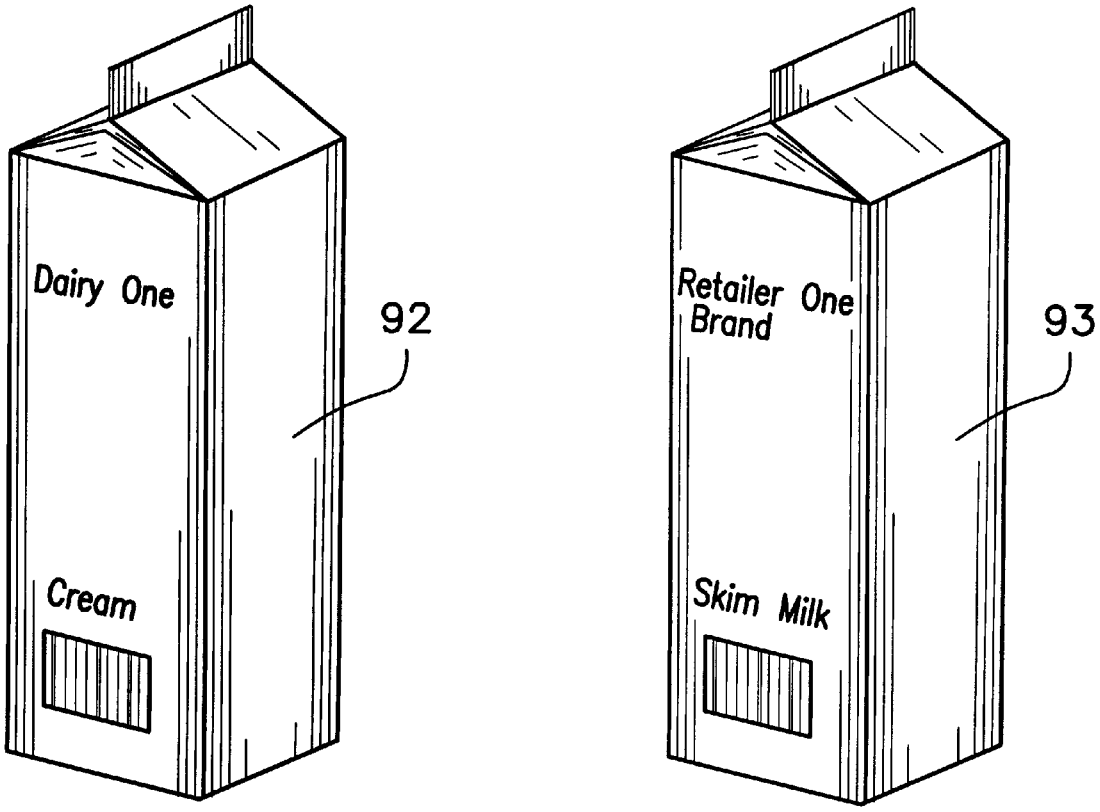
Figure 10:
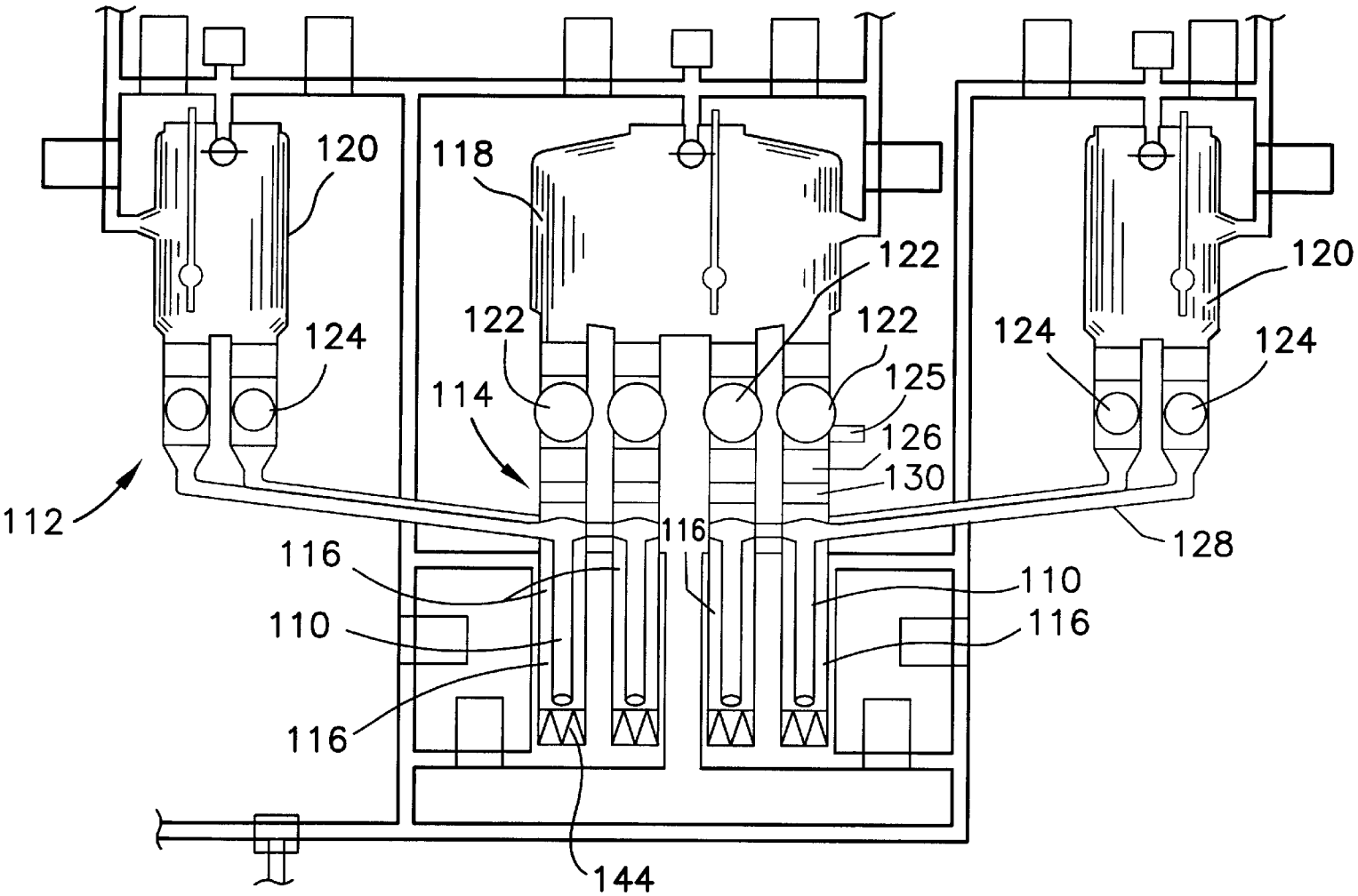

There is illustrated in FIG. 2 a schematic side view of a multiple magazine apparatus of the present invention integrated with an automatic carton loader and a carton blank opener;

There is illustrated in FIG. 3 a schematic top view a multiple magazine apparatus of the present invention integrated with an automatic carton loader and a carton blank opener;

There is illustrated in FIG. 4 a top perspective view of the multiple magazine apparatus of the present invention;

There is illustrated in FIG. 5 an isolated side view of a magazine and a blank retrieval mechanism;

There is illustrated in FIG. 5A an isolated front view of FIG. 5;

There is illustrated in FIG. 6 an isolated top plan view of the blank retrieval mechanism of the multiple magazine apparatus with a carton blank thereon;

There is illustrated in FIG. 7 an isolated side view of the multiple magazine apparatus of the present invention;

There is illustrated in FIG. 8 an isolated top perspective view of carton blanks on a conveyor of the multiple magazine apparatus of the present invention;

There is illustrated in FIG. 8A an isolated side view of carton blanks on a conveyor of the multiple magazine apparatus of the present invention;

There is illustrated in FIGS. 9 and 9A top perspective views of cartons of different sizes and products;

There is illustrated in FIG. 10 a schematic view of a dual stream filling system.

DETAILED DESCRIPTION OF THE INVENTION

Figure 1:
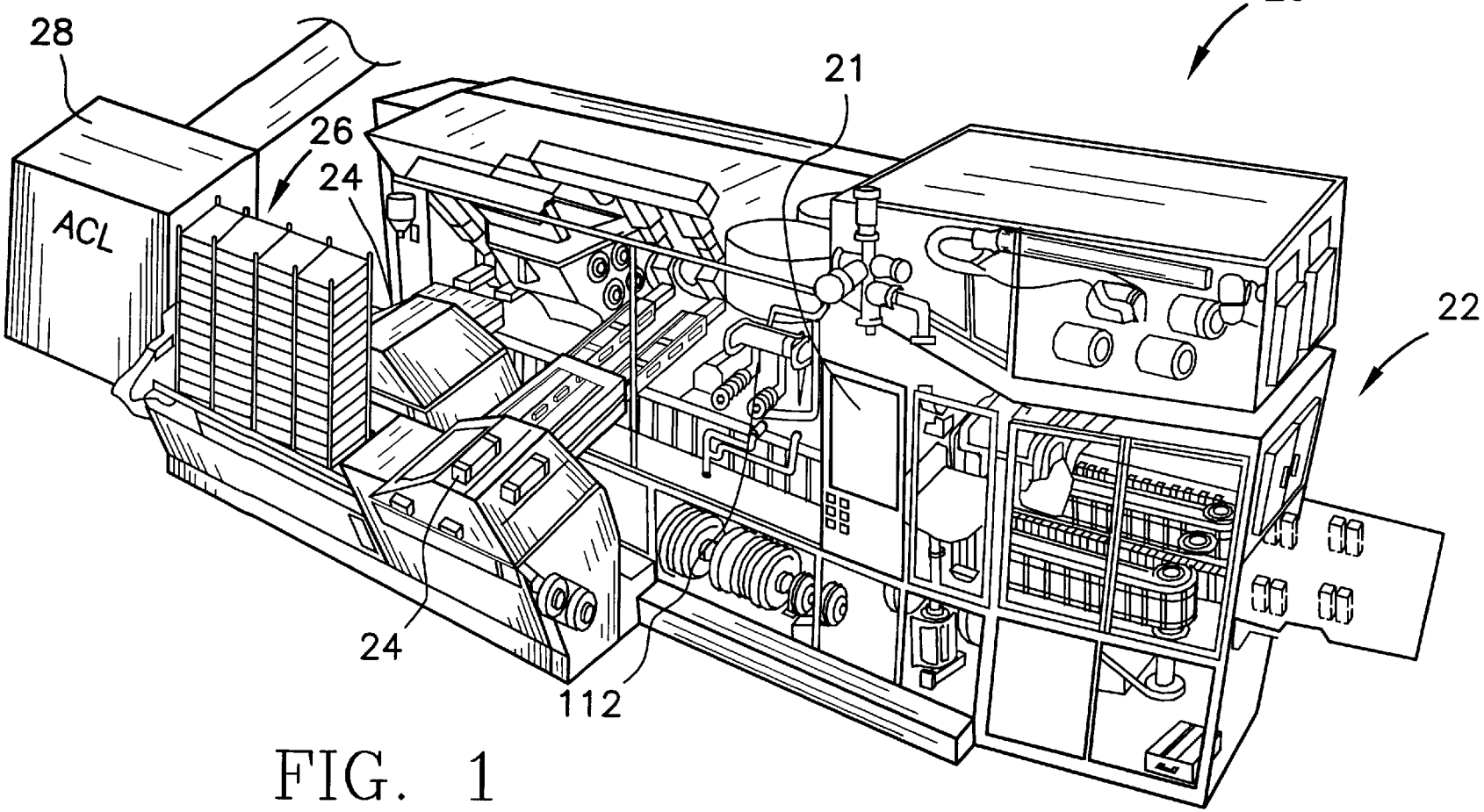

There is illustrated in FIG. 1 a packaging system generally designated 20. The packaging system 20 includes a packaging machine 22, a carton opener 22, a multiple magazine apparatus 26, and optionally an automatic carton loader ("ACL") 28. The packaging machine may be a typical linear form, fill and seal packaging machine such as a TETRA REX® packaging machine available from Tetra Pak, Incorporated of Chicago, Ill. The packaging machine 22 may have a programmable logic controller ("PLC") 21 to control the various operations of the packaging system 20.

A plurality of different blanks 30*a–d* are transported by group from the ACL 28 to the multiple magazine apparatus 26. As needed, blanks 30*a–d* are transported individually to the carton opener 24 for erection of the blank for placement on a mandrel of the packaging machine 22. After bottom forming on the mandrel, each carton is transported along the conveyor for eventual filling with a product at a filling station described below.

The multiple magazine apparatus of the present invention is illustrated in FIGS. 2–4. The multiple magazine 26 has a plurality of magazines 32*a–d* disposed in relation to a first conveyor 34. Although only four magazines are shown here, those skilled in the pertinent art will recognize that any number of magazines, either greater or lesser than four, may be provided without departing from the scope and spirit of the present invention. Each of the plurality of magazines 30*a–d* in this embodiment is provided with a retrieval mechanism 36*a–d* for retrieving a blank and placing it on the conveyor 34 for transport to the carton opener 24. A second conveyor 40 and a third conveyor 42 may also be utilized to transport carton blanks 30 on the carton opener 24 which is disposed on one end of the multiple magazine apparatus 24. The ACL 28 is positioned on the opposite end of the multiple magazine apparatus 24. The carton opener 24 has a plurality of carton ramps for transferring cartons to the mandrel of the packaging machine 22.

As shown in FIG. 3, the ACL 28 delivers parcels of blanks 45 to the multiple magazine apparatus 24 from blank storage areas 46*a–d*. The first robot 38 then transfers each unwrapped parcel 45*a–d* to a corresponding magazine 32*a–d*. The first robot 38 moves along a first ACL guide 39. The parcel of blanks 45 usually contains between one hundred and one thousand blanks 30. For a multiple magazine apparatus 24 having four magazines 32*a–d*, the ACL 28 would retrieve parcels of blanks 45*a–d* from four blank storage areas 46*a–d*. The parcel 45*a–d* retrieval is accomplished by second robot 41 which transfers a parcel 45*a–d* to an ACL conveyor 43. The ACL conveyor 43 transfers the parcels 45*a–d* to the first robot 38. The paper or plastic packaging of the parcel 45*a–d* is removed prior to transfer to the first robot 38. As shown in FIG. 4, the first robot 38 has an arm 51 for stacking the carton blanks 30 onto corresponding magazines 32*a–d*. The arm 51 is capable of vertical movement and is moved horizontally along the guide 39.

The retrieval mechanism 36 is best illustrated in FIGS. 5–7. Each retrieval mechanism 36 may include grips 52*a–b*, a gripping arm 54, an actuation arm 56 and a control mechanism 55 which may be a servomotor interconnected with PLC 21. Alternatively, the control mechanism could be a pneumatic cylinder, or the like. In this embodiment, each magazine 32*a–d* has a retrieval mechanism 36*a–d*. However, as shown in FIG. 8A, a single retrieval mechanism may be shared by all magazines 32*a–d*. Also, those skilled in the art will recognize that variations on the number of retrieval mechanisms 36 are possible without departing from the spirit and scope of the present invention. For example, a retrieval mechanism 36 may serve two or three magazines, and those a multiple magazine apparatus 24 having six magazines could have two retrieval mechanisms 36.

Returning to FIGS. 5–7, the retrieval mechanisms 36*a–d* are disposed below the conveyor 34. As best seen in FIG. 6, the conveyor 34 has a plurality of blank guides 49 for maintaining each blank 30 during the transfer to the carton opener 24. The conveyor 34 may have a continuous belt 61 centrally disposed for proving movement to the blanks 30. The conveyor 34 is positioned underneath the magazines 32*a–d* with retrieval mechanisms 36*a–d* positioned accordingly for removing a blank 30 one at a time from each of the magazines 32*a–d* as instructed by control mechanism 55. In operation, grips 52*a–b* attach to a blank 30, then lowers the blank 30 onto the conveyor 34 within adjacent guides 49. Once positioned on the conveyor 34, the grips 52*a–b* release the blank 30. The grips 52*a–b* may be mechanically controlled or vacuum grips. It is only important that the grips 52*a–b* are capable of engaging one blank at a time for transfer from the magazine 32 to the conveyor 34. The grips 52*a–b* should be able to withdraw a blank 30 from the magazine which is defined by magazines walls 33 with ledges 35 to support the blanks 30 thereon. The grips enter through an aperture 37 of each magazine 32. The retrieval mechanism may also only have one grip 52 to engage the blanks 30.

As shown in FIG. 8, as the blanks 30 are transferred to the opening device 24, a bar code reader 70 may read a bar code of a blank 30 to instruct the packaging machine 22 on the volume and filling requirements of the carton to be erected from the blank 30.

A system for reading the bar code of a carton or blank is disclosed in co-pending U.S. patent application Ser. No. 09/063,763 filed on Apr. 21, 1998 an entitled Multi-Product Filling Machine With Bar code Reader, which is hereby incorporated by reference in its entirety.

As previously mentioned, another embodiment of the retrieval mechanism 36 is illustrated wherein only one retrieval mechanism 36 is utilized for all four magazines 32*a–d*. The retrieval mechanism 36 is disposed on a track 60 form movement to and from magazines 32*a–d* as directed by the PLC. It is contemplated in the present invention that a gate mechanism may be employed on each magazine to release blanks without the need of grips 52*a–b*.

FIGS. 9 and 9A illustrated various cartons that may be consecutively produced on a packaging system 20 of the present invention. For example, magazine 32*a* may hold blanks for two percent milk packaged in a one liter carton 90. Magazine 32*b* may hold blanks for whole milk packaged in a one liter carton 91. Magazine 32*c* may hold blanks for cream packaged in a five-hundred milliliter carton 92. Magazine 32*d* may hold blanks for skim milk packaged in a five-hundred milliliter carton 93. The operator would program the packaging system 20 to produce a predetermined quantity of each product in each container. In this manner, the PLC would instruct the retrieval mechanisms 36*a–d* to remove that predetermined number of blanks 30*a–d* from each magazine 32*a–d*. Alternatively, the system 20 may have set mode of operation which automatically removes blanks 30*a–d* from each of the magazines 32*a–d* at set intervals. In this operation, the bar code reader would inform the packaging machine which product and volume should be filled in the corresponding carton.

There is illustrated in FIG. 10 a dual stream filling system of co-pending U.S. patent application Ser. No. 08/897,554 filed on Jul. 21, 1997 and an entitled Dual Stream Filling Valve, which is hereby incorporated by reference in its entirety. The filling system 112 has a primary tank 118 and secondary tanks 120 in flow communication with nozzles 144. Pumps 122 and 124 control the flow of the product into cartons, not shown, which are positioned under the nozzles 144. Each primary fill pipe 116 has a secondary fill pipe 110 concentrically enclosed therein. Pump mechanisms 124 control the flow of the secondary product from the secondary tanks 120 to the secondary fill pipes 110. The pump mechanisms 122 control the flow of the primary product from the primary tank 118 to primary fill pipes 116. In operation, the secondary product may be cream and the primary product skim milk. The PLC with instructions from a bar code reader 70 if necessary, instructs the filling system 112 to fill a predetermined quantity of cartons with a specific product.

For example, if the product is two percent milk, the fillings system 112 dispenses a set quantity of skim milk from the primary product tank 118 and a set quantity of cream from secondary tanks 120 directly into a carton for mixing. This filling system allows for the continuous product of different products without the need to deactivate the packaging machine 22 to produce a different product. A similar filling system is disclosed in U.S. Pat. No. 5,687,779 which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A packaging system for processing different products, the packaging system comprising:

a single form fill seal packaging machine;

a multiple magazine apparatus containing a plurality of different blanks in a plurality of magazines disposed in relation to a conveyor;

a carton blank opener integrated between the multiple magazine apparatus and the packaging machine, the carton blank opener erecting blanks which are transferred from the conveyor of the multiple magazine apparatus; and an automatic carton loader for supplying blanks to each of the magazines of the multiple magazine apparatus.

2. The packaging system according to claim 1 wherein each of the plurality of magazines are disposed perpendicular to the conveyor.

3. The packaging system according to claim 1 further comprising a second multiple magazine apparatus and a second carton blank opener integrated between the second multiple magazine apparatus and the packaging machine, the second carton blank opener erecting blanks which are transferred from a conveyor of the second multiple magazine apparatus.

4. The packaging system according to claim 1 further comprising a bar code reader for reading a bar code on each of the carton blanks to instruct the packaging machine for size and filling requirements of the carton fabricated from the carton blank.

5. The packaging system according to claim 1 wherein the multiple magazine apparatus further comprises a plurality of retrieval mechanisms disposed in relation to each of the plurality of magazines, the plurality of retrieval mechanisms retrieving a each of the plurality of different blanks from each of the plurality of magazines and transferring the blanks individually to the conveyor for transport to the carton opener.

6. The packaging system according to claim 5 wherein each of the plurality of retrieval mechanisms comprises a control mechanism to control the number of blanks retrieved from a corresponding magazine.

7. The packaging system according to claim 1 wherein the packaging machine comprises a dual stream filling system having a plurality of primary fill pipes with secondary fill pipes concentrically disposed therein.

8. The packaging system according to claim 3 wherein the packaging machine comprises two processing lines, each processing line receiving erected cartons from a corresponding carton opener.

9. An apparatus for handling blanks to be transferred to a form, fill and seal packaging machine, the apparatus comprising:

a conveyor;

a plurality of magazines capable of holding a predetermined quantity of carton blanks therein;

means for retrieving blanks from each of the plurality of magazines;

a carton opener disposed at one end of the conveyor; and an automatic carton loader for providing a quantity of blanks to each of the magazines.

10. The apparatus according to claim 9 wherein one of the plurality of magazines is sized for one liter carton blanks and another of the plurality of magazines is sized for five-hundred milliliter carton blanks.

11. The apparatus according to claim 9 further comprising a bar code reader for reading a bar code on each of the carton blanks to instruct the packaging machine for size and filling requirements of the carton fabricated from the carton blank.

12. The apparatus according to claim 9 wherein each of the plurality of retrieval mechanisms comprises a control mechanism to control the number of blanks retrieved from a corresponding magazine.

13. The apparatus according to claim 9 wherein each of the magazines is disposed perpendicularly above the conveyor.

14. The apparatus according to claim 9 wherein each of the retrieval mechanisms comprises a plurality of grips, each of the plurality of grips attached to an arm actuated by a control mechanism.

15. The apparatus according to claim 12 further comprising a programmable logic controller for directing each of the control means.

16. A method for consecutively form, fill and sealing different carton blanks for different products on a single form, fill and seal packaging machine, the method comprising:

retrieving a first carton blank from a first of a plurality of magazines disposed above a conveyor for conveying blanks to a carton blank opener;

retrieving a second carton blank from a second of a plurality of magazines disposed above the conveyor, the second carton blank different from the first carton blank;

erecting the first carton blank at the carton opener into a first carton;

erecting the second carton blank at the carton opener into a second carton;

conveying the first and second cartons along a conveyor of the packaging machine;

filling the first carton with a first product at a filling system of the packaging machine; and filling the second carton with a second product at the filling system of the packaging machine.

17. The method according to claim 16 further comprising reading a bar code on each of the carton blanks to instruct the filling system on which product to fill each of the cartons with at the filling system of the packaging machine.

18. The method according to claim 16 wherein retrieving the first and second carton blanks is accomplished by grippers disposed below the conveyor at each of the plurality of magazines.

* * * * *